US006648164B1

(12) United States Patent
DeCola et al.

(10) Patent No.: US 6,648,164 B1
(45) Date of Patent: Nov. 18, 2003

(54) CONTAINER AND LID ASSEMBLY

(75) Inventors: Mike DeCola, Concord, OH (US); Mike Doran, Edinburg, PA (US)

(73) Assignee: Cleveland Steel Corporation, Cleveland, OH (US)

( * ) Notice: Subject to any disclaimer, the term of this patent is extended or adjusted under 35 U.S.C. 154(b) by 0 days.

(21) Appl. No.: 09/522,391

(22) Filed: Mar. 10, 2000

Related U.S. Application Data

(60) Provisional application No. 60/167,475, filed on Nov. 24, 1999.

(51) Int. Cl.[7] ..... B65D 25/08; B65D 41/12

(52) U.S. Cl. ..... 220/505; 220/309.1; 220/310.1; 220/528

(58) Field of Search ..... 220/561, 23.83, 220/23.87, 23.89, 506, 505, 521, 527, 528, 309.2, 310.1

(56) References Cited

U.S. PATENT DOCUMENTS 2,981,435 A * 4/1961 McCarthy ..... 220/522
3,620,399 A * 11/1971 Rapeaud ..... 220/23.87
3,834,578 A * 9/1974 Smith et al. ..... 220/378
4,773,556 A * 9/1988 Smith ..... 220/578
5,027,972 A * 7/1991 Bartholomew ..... 220/528
5,181,619 A * 1/1993 Noble ..... 220/521
5,195,042 A * 3/1993 Ferraro et al. ..... 364/468
5,392,901 A * 2/1995 Kuray et al. ..... 220/528
5,954,218 A * 9/1999 Starr ..... 220/254
5,984,137 A * 11/1999 Grosjean ..... 220/529
6,065,628 A * 5/2000 Page ..... 220/309.2

* cited by examiner

*Primary Examiner*—Lee Young
*Assistant Examiner*—Niki M. Eloshway
(74) *Attorney, Agent, or Firm*—Calfee, Halter & Griswold; Paul E. Szabo

(57) ABSTRACT

The present invention provides a pail and cradle system and method for collectively containing one or more chemicals. The cradle comprises an interior surface having an opening with a circumferential rim for reception onto the lip of a pail. The cradle further comprises an extended return so that when the lugs of a lid are crimped onto the pail, the cradle return is clamped by the lugs against the sidewall of the pail. A gasket is mounted under the rim of the cradle so that a seal is formed between the cradle and the top lip of the pail. The lid for the pail further comprises a groove in which a gasket is mounted for sealing the lid against the rim of the cradle when the lid is crimped to the pail assembly.

21 Claims, 4 Drawing Sheets

CONTAINER AND LID ASSEMBLY

This application claims the benefit of provisional application No. 60/167,475 filed Nov. 24, 1999.

This invention relates in general to product packaging and more specifically to a method and device for packaging chemicals.

BACKGROUND OF THE INVENTION

When chemicals are transported in route to their final destination they need to be placed in a container that will ensure that the chemicals will not leak into the surrounding environment. When chemicals spill out of their container, they can create a variety of health, safety, and environmental problems. Thus it is imperative to safeguard against chemicals from leaking into the surrounding environment. Therefore, before chemicals are shipped, the container in which the chemicals are placed must be able to pass the required safety tests to ensure that the chemicals will not be released from the container, even when the container has been damaged. One of the tests that is imposed by the Federal Department of Transportation on containers used in shipping chemicals is referred to as the 'drop test,' which is illustrated in FIG. 1. In order to pass the drop test, the container must not leak after it is dropped from a height proportional to the chemical's specific gravity onto a non-yielding surface. In particular, for steel pails, the drop test must be passed for two different orientations of the container. In a first orientation the center of gravity is aligned with the point of impact and the bottom chime of the steel pail. In a second orientation as shown in FIG. 1, the pail is inverted so that the assembly is dropped on the lid. Then, the center of gravity is aligned with the point of impact and the top chime of the steel pail. The dropped samples are then observed for any leakage of the dangerous chemicals.

Designing a steel pail such that it is able to pass the drop test and contain the chemicals without leaking is a challenging task. The difficulty of this task is amplified when it is desired to design a steel pail that will separately house two chemicals. The general design for such a container, commonly referred to as a pail and cradle, encompasses a plastic cradle, which rests along the upper lip of the pail and separates the chemicals. The prior art cradle and pail designs have failed to pass the drop test consistently. The traditional cradle and pail designs often failed the drop test because the cradle slid off the top lip of the pail and down into the dangerous chemical. Traditional cradle and pail designs also frequently failed when the seal along the top of the pail was broken, thus allowing the dangerous chemicals to leak out of the container.

SUMMARY OF THE INVENTION

The present invention provides in one aspect a container system for storing and transporting one or more chemicals, comprising a pail having a bottom joined with one or more sidewalls forming an opening, with the upper end of the sidewalls forming a rim. The system further comprises a cradle having an interior surface forming a storage receptacle and an opening with a circumferential rim forming a groove aligned for mating with the rim of the pail. A gasket is mounted within the cradle groove. The cradle further comprises an elongated return extending down from the rim. The lid for the pail comprises a circumferential groove with a gasket positioned therein and aligned for reception over the rim of the cradle and the pail rim, and one or more lugs for crimping the lid and cradle to the pail.

The present invention provides in another aspect a method of collectively packaging two chemicals separately, comprising the steps of placing a first chemical into the bottom portion of a pail; inserting a gasket under a rim formed at the top of a cradle; inserting the rim of the cradle onto the rim of the pail, wherein the cradle has an extended return that outwardly extends from the cradle rim; placing a second chemical in a recess of the cradle; mounting a groove of a lid having a gasket mounted therein over the rim of a cradle; and crimping one or more lugs of the lid so that the crimped lugs secure the extended return of the cradle to the sidewall of the pail and seal the lid to the pail.

The present invention provides in yet another aspect a cradle for use in a pail comprising an inner surface forming a recess and an opening having a circumferential rim for receiving a lip of a pail; and an extended return outwardly extending down from the rim.

The present invention provides in still another aspect a container system for storing and transporting one or more chemicals, comprising a pail having a bottom joined with one or more sidewalls forming an opening bounded by a circumferential rim. The container system further comprises a cradle having an opening defined by a circumferential rim forming a groove aligned for mating with the rim of the pail. A lid for the pail comprises a circumferential groove aligned for reception onto the rim of the cradle and the rim of the pail, and one or more lugs for securing the lid and the cradle to the pail. The cradle further comprises a return extending outwardly from the cradle rim, with the return having a length sufficient to be clamped by the lugs against the sidewall when the lid lugs are crimped onto the assembly.

DETAILED DESCRIPTION OF THE INVENTION

Figure 1:
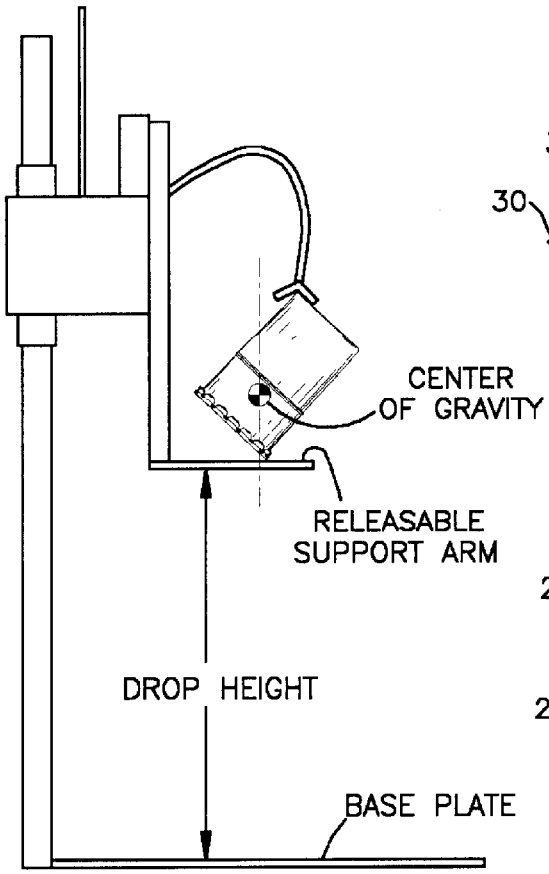
FIG. 1 is a schematic representation of the drop test imposed on a pail.
Figure 2:
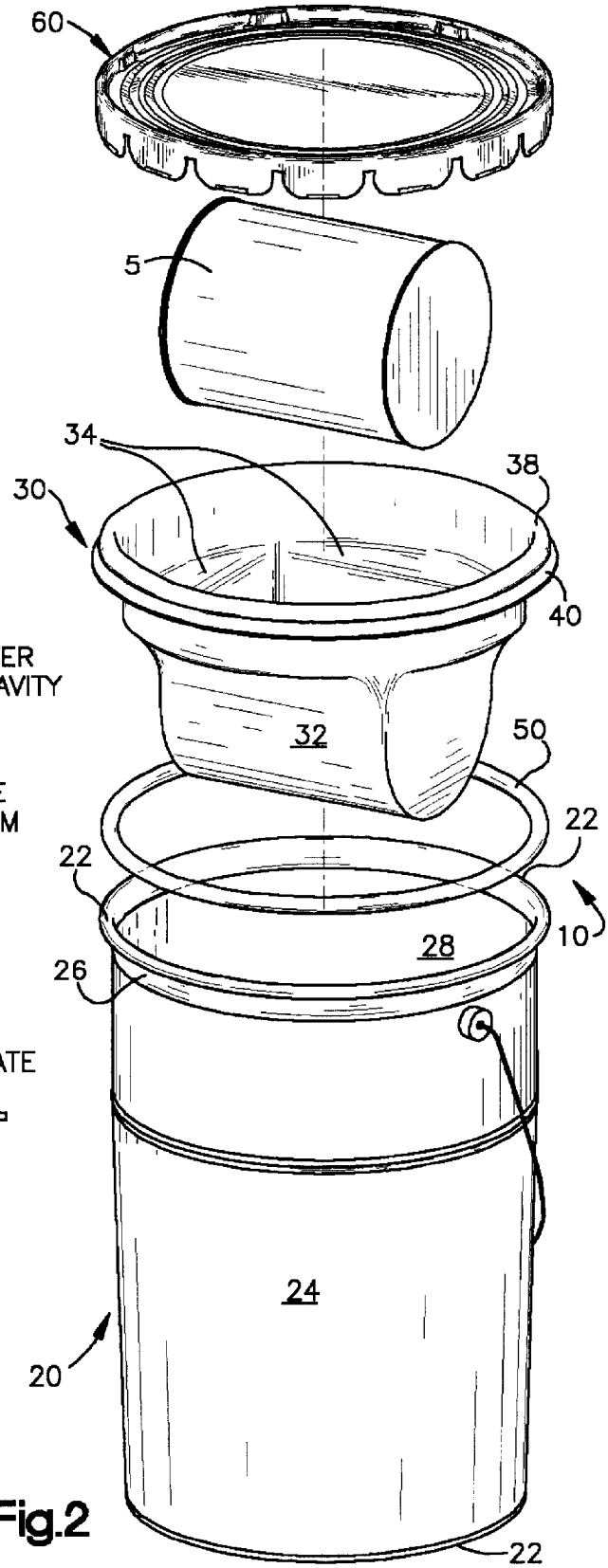
FIG. 2 is an exploded view of the steel pail and the cradle assembly of the present invention.

The present invention comprises a method and device for separately containing two different chemicals into a single container or package. For example, the invention provides a container for separately storing a dangerous chemical within the pail and a catalyst within a cradle so that only a single shipping container is needed. As shown in FIG. 2, the present invention comprises a cradle and pail system 10 which includes a pail 20 and cradle 30. The pail 20 has a bottom wall 22 mated or joined together with one or more sidewall(s) 24 forming an interior storage cavity 25 for storing a liquid or solid substance therein. The sidewalls 24 preferably form a cylindrical container, however other cross-sectional container shapes such as a square or rectangle would work for the invention. The pail 20 has an opening 28 having an upper portion forming a circumferential rim 21 having an outwardly extending curved flange or curl having its lower edge curled under to form a lip 22. Underneath the lip 22 is a circumferential groove 26 for securing the crimped lugs 66 of a lid 60 to the pail 20. The pail 20 may be formed of any suitable material, such as a polymer or metal; however, the pail is preferably steel. The pail 20 may further optionally comprise a handle 29 or a set of handles mounted upon the exterior of the pail for enhancing the portability of the pail.

Figure 3:
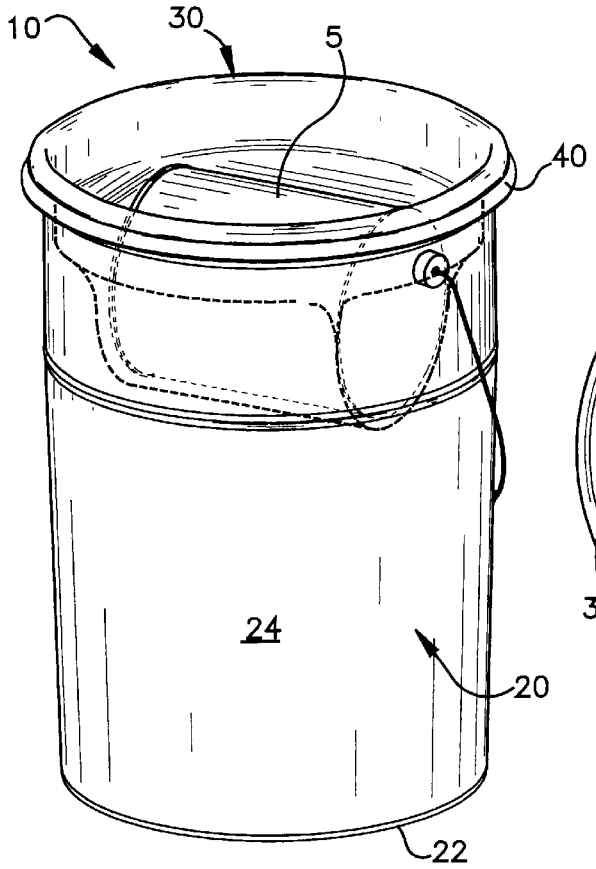
FIG. 3 is a perspective view of the cradle mounted within the pail with a separate storage container (not part of the invention) mounted within the recess of the cradle.
Figure 4:
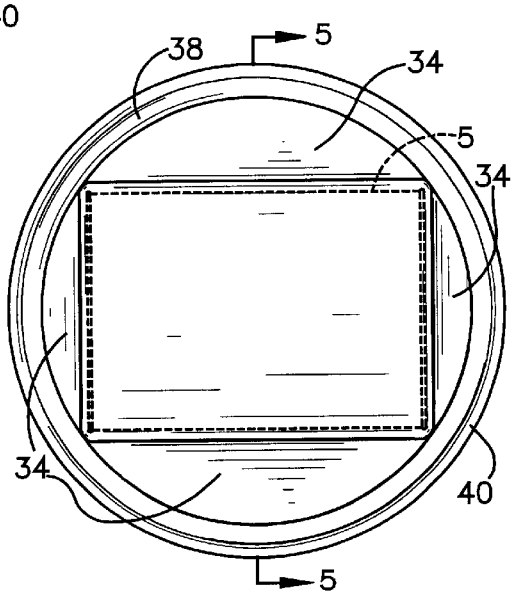
FIG. 4 is a top view of the cradle assembly shown with the separate storage container mounted within the recess.
Figure 5:
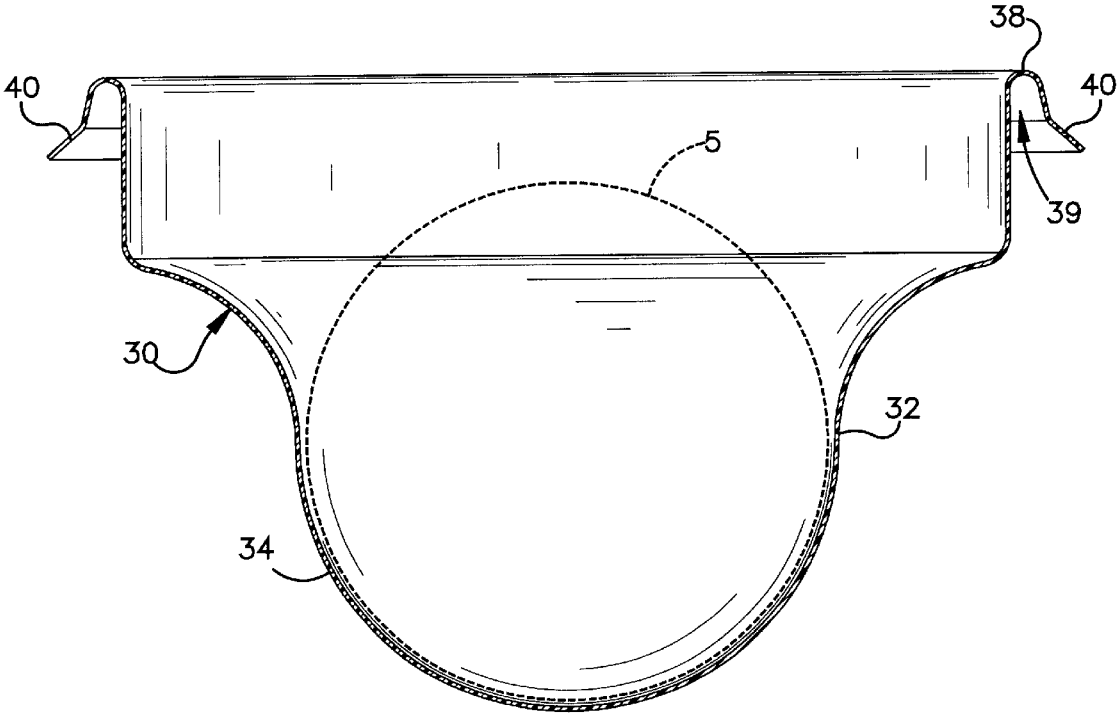
FIG. 5 is a side view of the cradle assembly as shown in FIG. 4.

The cradle 30, as shown in FIGS. 3–5, is shaped and sized to be contained within the upper portion of the interior of the pail 20. Thus if the pail has a cylindrical shape, the upper portion of the cradle is also preferably cylindrical in shape in order to fit within the inner contour of the pail, as shown in FIG. 2. The cradle 30 has an interior molded surface forming a recess 32 for storing one or more separately packaged containers such as a catalyst. The cradle recess 32 is preferably molded with indentations 34 as shown in FIGS. 2 through 5, which conform to the shape of the container in order to retain it in place. The cradle is preferably molded of a polymer material, and preferably comprises a high or low density polyethylene.

Figure 8:
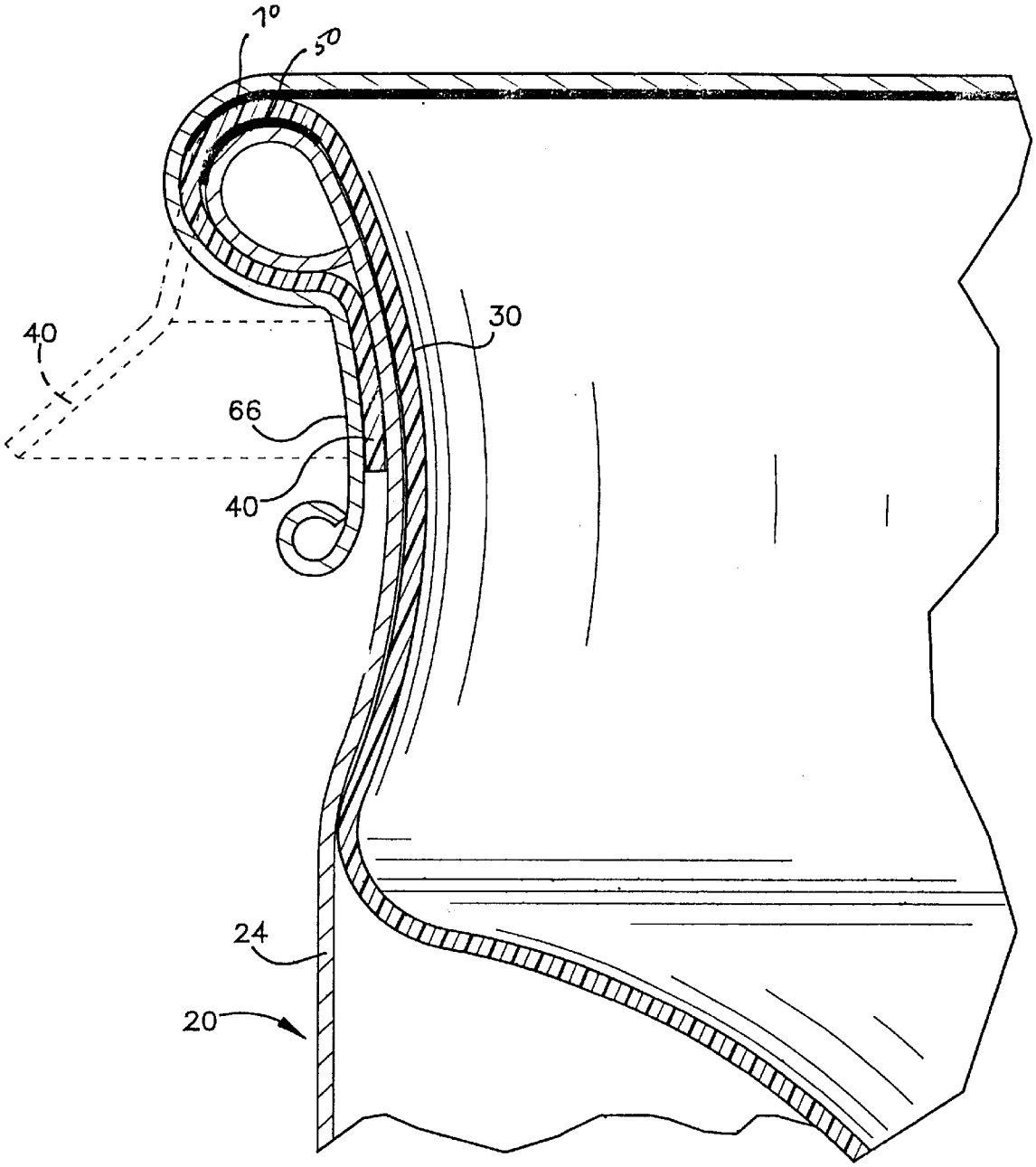
FIG. 8 is a cross-sectional view of the cradle and pail assembly in the direction 8—8 of FIG. 7.

The cradle 30 has an opening 36 having an upper portion forming a circumferential rim 38. The rim 38 of the cradle 30 is sized and shaped for mounting over the top lip 22 of the pail 20. Outwardly extending from the rim 38 of the cradle 30 is an extended return or skirt 40. The length of the return 40 is sized such that when the rim 38 of the cradle 30 is mounted over the lip 22 of the pail 20, the return 40 extends down past the lip 22 so that when the lid lugs are crimped, the return is also crimped and held securely against the outer sidewall 24 of the pail 20 as shown in FIG. 8. The clamping of the return 40 against the sidewall 24 by the lugs prevents the slipping of the cradle 30 into the pail 20 which may occur when a container is damaged during shipping. In order to allow for the clamping action of the return 40, the length of the return 40 of a standard sized pail is preferably in the range of about 0.5 inch to about 1.0 inch, and more preferably about 0.75 inches. However, depending upon the size of the container and lugs, the length of the extended return may vary.

The cradle and pail system 10 further comprises a cradle gasket 50 for insertion underneath the rim 38 of the cradle 30 in groove 39, so that when the rim 38 of the cradle 30 is mounted upon the lip 22 of the pail 20, the gasket 50 forms a seal there between. The cradle gasket 50 is preferably a polychloroprene (neoprene) tubular gasket; however, other shapes and materials would also work for the invention.

Figure 6:
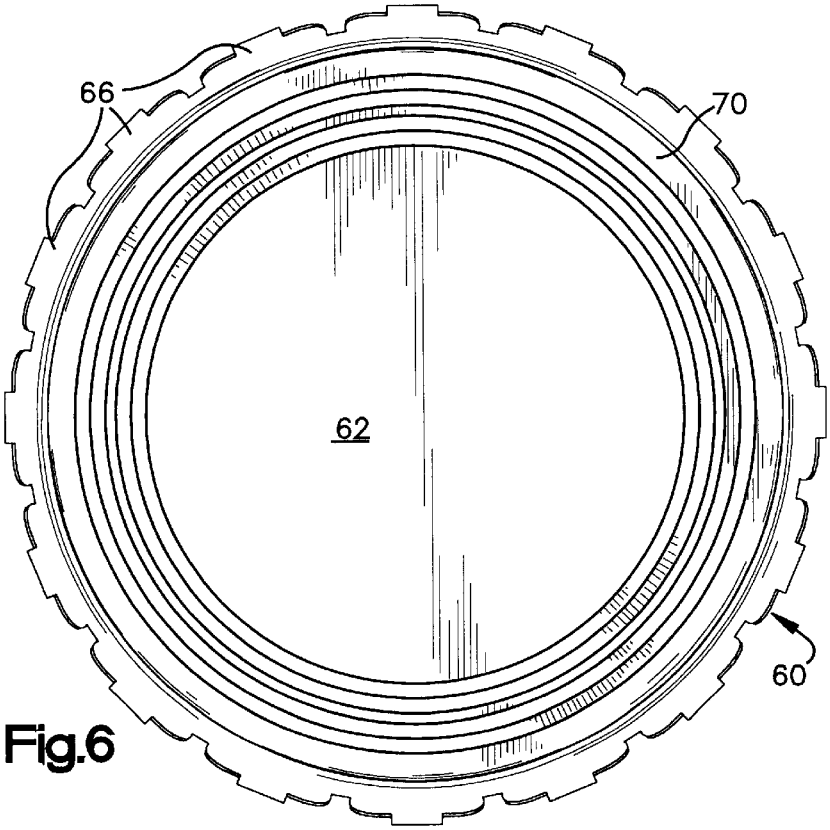
FIG. 6 is a bottom view of the underside of the pail lid.
Figure 7:
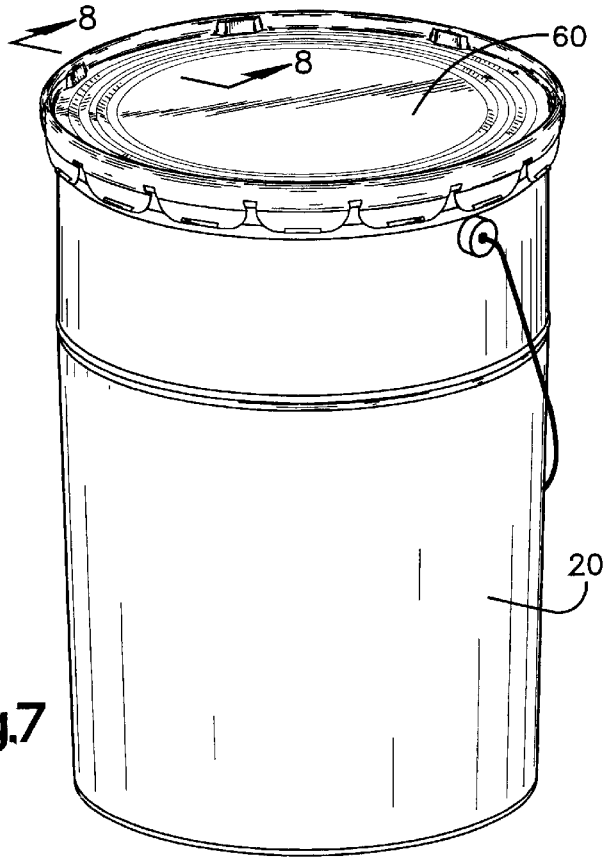
FIG. 7 is a perspective view of the cradle and pail assembly completely assembled with the pail lid in place.

As shown in FIG. 6, the pail and cradle system 10 further comprises a lid 60 which includes a planar surface 62 which is generally round or square depending on the cross-sectional shape of the container. Located on the periphery of the planar surface is a circumferential groove or channel 64 which is designed to be received over the rim of the cradle and the top lip 22 of the pail 20. A flow-in gasket 70 is provided within the groove 64 in order to seal the lid with the rim of the pail 20. Preferably the flow-in gasket 70 is styrene-butadiene (SBR) rubber, although other known sealing materials would work for the invention. Preferably the gram weight of the gasket is in the range of about 5 to about 18 grams, more preferably in the range of about 8 to about 15 grams, and most preferably about 10 grams for a standard size pail assembly. Preferably, the amount of gasket material is sized so that the entire gasket is compressed due to the crimping force on the container lugs.

The lid 60 further comprises one or more lugs 66 which extend downwardly from the, lid 60 and when crimped against the sidewall 24 of the pail 20, secure the lid 60 to the pail 20. In addition, when the lugs 66 are crimped, the return 40 of the cradle 30 is additionally secured to the sidewall 24 of the pail to ensure that the cradle rim 38 does not unseat itself from the pail lip 22. It is preferable to increase the amount of crimping force applied to the lugs, which is preferably at least about 95 psi for a standard container.

The assembly of the pail and cradle system may now be described. In order to package one or more chemicals into separate portions of the container assembly, a first type of chemical is poured into the interior cavity of the pail 20. Once the first chemical has been added to the pail, a cradle 30 having a cradle gasket 50 is secured under the cradle rim 38, and the cradle rim 38 is aligned and positioned onto the pail so that the cradle rim 38 is seated over the lip 22 of the pail 20 with the cradle gasket 50 forming a seal there between. The cradle is designed such that its upper rim portion curls over the top lip 22 of the pail 20 and forms a return 40 that extends down a portion of the outer sidewall of the pail. Once the cradle 30 is secured on the top lip 22 of the pail 20, a second separately packaged chemical, typically a catalyst, is placed into the recess 32 of the cradle 30. Next, a lid 60, having a gasket positioned within the circumferential groove 64 of the lid 40 is aligned and mated onto the cradle rim 38. The lid lugs 66 are then crimped down against the sidewall 24 of the pail 20, so that the cradle return 40 is sandwiched or clamped between the lid lugs 66 and the sidewall 24 of the pail, thus securely sealing the pail and cradle by completely compressing both of the gaskets and locking the cradle into position. Once the pail has been sealed, the chemicals can be safely transported as the container will meet the safety drop test, and thereby ensure that the chemicals will not leak to the outside of the container or will not be mixed within the container.

Although the invention has been disclosed and described with respect to certain preferred embodiments, certain variations and modifications may occur to those skilled in the art upon reading this specification. For example, the invention could be utilized on a pail and lid assembly that is not cylindrical in shape, or with a lid having various configurations of lug lids and dimensions. Any such variations and modifications are within the purview of the invention notwithstanding the defining limitations of the accompanying claims and equivalents thereof.

We claim:

1. A container for storing and transporting one or more chemicals, comprising:

a pail having a bottom joined with one or more sidewalls forming an opening with the upper end of the sidewalls forming a rim;

a cradle having an interior surface forming a storage receptacle and an opening with a circumferential rim forming a groove aligned for mating with said rim of said pail, wherein said cradle further comprising an elongated return outwardly extending down from said rim;

a gasket mounted within the cradle groove;

a lid comprising a circumferential groove with a gasket positioned within said groove and aligned for reception over the rim of the cradle and the pail rim, and one or more lugs crimped to the cradle over the pail rim.

2. The system of claim 1 wherein said pail is steel.

3. The system of claim 1 wherein said cradle is a polymeric plastic.

4. The system of claim 1 wherein said cradle is a low density polyethylene.

5. The system of claim 1 wherein said cradle is molded to conform with the inner contour of the pail and wherein said cradle forms a recess wherein a second chemical can be placed.

6. The system of claim 1 wherein said cradle is molded with indents to fit a smaller container.

7. The system of claim 1 wherein said cradle gasket is neoprene.

8. The system of claim 1 wherein said cradle gasket is tubular.

9. The system of claim 1 wherein said return has an extended length sufficient to be crimped against the outer sidewall of the pail by said lugs.

10. The system of claim 1 wherein said lid gasket is styrene-butadiene rubber.

11. The system of claim 1 wherein the gram weight of the lid gasket is in the range of about 5 grams to about 18 grams.

12. The system of claim 1 wherein said lugs are crimped with at least 95 pounds per square inch of crimping force.

13. The system of claim 1 wherein said return has an extended length in the range of about 0.5 to about 1 inches.

14. The system of claim 1 wherein said return has an extended length in the range of about 0.75 inches.

15. A method of collectively packaging a first chemical and second chemical separately into a secure container system, said method comprising the steps of:

placing the first chemical into the bottom portion of a pail;

inserting a gasket under a rim formed at the top of a cradle;

inserting the rim of the cradle onto the rim of said pail, wherein said cradle has an extended return that outwardly extends from said cradle rim;

placing the second chemical in a recess of said cradle;

mounting a groove of a lid having a gasket mounted therein over the rim of a cradle; and securing the extended return of the cradle by crimping lugs of said lid to the sidewall of the pail.

16. The method of claim 15 wherein said second chemical is placed in a second container prior to being placed into said recess of said cradle.

17. The method of claim 15 wherein said crimping is done with at least 95 pounds per square inch of crimping force.

18. A container system for storing and transporting one or more chemicals, comprising:

a pail having a bottom joined with one or more sidewalls forming an opening bounded by a circumferential rim;

a cradle having an opening defined by a circumferential rim forming a groove aligned for mating with said rim of said pail;

a lid for said pail comprising a circumferential groove aligned for reception onto the rim of the cradle and the rim of the pail;

said lid further comprising one or more lugs secured to the cradle and to the pail, wherein said cradle further comprises a return extending outwardly from said cradle rim, with said return having a length sufficient to be clamped by said lugs against the sidewall when said lid lugs are crimped onto the assembly.

19. The system of claim 18 further comprising a gasket mounted within the cradle groove.

20. The system of claim 18 further comprising a gasket positioned within said lid groove.

21. The system of claim 20 wherein said gasket is sized such that entire gasket mass is compressed when lugs are crimped.

* * * * *